US009337537B2

(12) United States Patent
Hu et al.

(10) Patent No.: US 9,337,537 B2
(45) Date of Patent: May 10, 2016

(54) ANTENNA WITH TUNABLE HIGH BAND PARASITIC ELEMENT

(71) Applicant: Apple Inc., Cupertino, CA (US)

(72) Inventors: Hongfei Hu, Santa Clara, CA (US); Mattia Pascolini, San Mateo, CA (US); Enrique Ayala Vazquez, Watsonville, CA (US); Matthew A. Mow, Los Altos, CA (US); Dean F. Darnell, San Jose, CA (US); Ming-Ju Tsai, Cupertino, CA (US); Robert W. Schlub, Cupertino, CA (US); Nanbo Jin, Sunnyvale, CA (US); Yuehui Ouyang, Sunnyvale, CA (US); Liang Han, Sunnyvale, CA (US); David Pratt, Gilroy, CA (US)

(73) Assignee: Apple Inc., Cupertino, CA (US)

( * ) Notice: Subject to any disclaimer, the term of this patent is extended or adjusted under 35 U.S.C. 154(b) by 428 days.

(21) Appl. No.: 13/890,013

(22) Filed: May 8, 2013

(65) Prior Publication Data

US 2014/0333496 A1 Nov. 13, 2014

(51) Int. Cl.
*H01Q 1/24* (2006.01)
*H01Q 5/00* (2015.01)
(Continued)

(52) U.S. Cl.
CPC ..... *H01Q 5/0024* (2013.01); *H01Q 1/243* (2013.01); *H01Q 5/30* (2015.01); *H01Q 5/321* (2015.01); *H01Q 5/378* (2015.01); *H01Q 9/0421* (2013.01)

(58) Field of Classification Search
USPC ..... 343/700 MS, 702, 745, 833
See application file for complete search history.

(56) References Cited

U.S. PATENT DOCUMENTS 7,265,720 B1 * 9/2007 Ponce De Leon ..... H01Q 1/243 343/700 MS
7,345,634 B2 3/2008 Ozkar et al.
(Continued)

FOREIGN PATENT DOCUMENTS

CN 102684722 9/2012
CN 202444051 9/2012
(Continued)

OTHER PUBLICATIONS

Jin et al., U.S. Appl. No. 13/846,471, filed Mar. 18, 2013.
(Continued)

*Primary Examiner* — Tan Ho
(74) *Attorney, Agent, or Firm* — Treyz Law Group, P.C.; G. Victor Treyz; Michael H. Lyons

(57) ABSTRACT

Electronic devices may be provided that include radio-frequency transceiver circuitry and antennas. An antenna may be formed from an antenna resonating element and an antenna ground. The antenna resonating element may have a shorter portion that resonates at higher communications band frequencies and a longer portion that resonates at lower communications band frequencies. The resonating element may be formed from a peripheral conductive electronic device housing structure that is separated from the antenna ground by an opening. A parasitic monopole antenna resonating element or parasitic loop antenna resonating element may be located in the opening. Antenna tuning in the higher communications band may be implemented using an adjustable inductor in the parasitic element. Antenna tuning in the lower communications band may be implemented using an adjustable inductor that couples the antenna resonating element to the antenna ground.

17 Claims, 9 Drawing Sheets

(51) Int. Cl.

| | |
|---|---|
| ***H01Q 9/04*** | (2006.01) |
| ***H01Q 5/30*** | (2015.01) |
| ***H01Q 5/321*** | (2015.01) |
| ***H01Q 5/378*** | (2015.01) |

(56) References Cited

U.S. PATENT DOCUMENTS

| | | | | |
|---|---|---|---|---|
| 7,405,701 | B2 | 7/2008 | Ozkar | |
| 7,551,142 | B1 | 6/2009 | Zhang et al. | |
| 7,733,271 | B2 | 6/2010 | Moon et al. | |
| 8,855,724 | B2 * | 10/2014 | Bahramzy | H01Q 1/245 343/700 R |
| 2004/0113845 | A1 * | 6/2004 | Mikkola | H01Q 1/243 343/700 MS |
| 2008/0266190 | A1 * | 10/2008 | Ohba | H01Q 1/243 343/702 |
| 2010/0214180 | A1 | 8/2010 | Krogerus | |
| 2011/0012794 | A1 | 1/2011 | Schlub et al. | |
| 2012/0299785 | A1 | 11/2012 | Bevelacqua | |
| 2013/0257661 | A1 * | 10/2013 | Yuasa | H01Q 1/244 343/702 |

FOREIGN PATENT DOCUMENTS

| | | |
|---|---|---|
| CN | 103022647 | 4/2013 |
| EP | 2528165 | 11/2012 |
| WO | 02078124 | 10/2002 |
| WO | 2013010145 | 1/2013 |

OTHER PUBLICATIONS

Hu et al., U.S. Appl. No. 13/366,142, filed Feb. 3, 2012.
Pascolini et al., U.S. Appl. No. 13/343,657, filed Jan. 4, 2012.
Bevelacqua et al., U.S. Appl. No. 13/860,396, filed Apr. 10, 2013.
Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Ouyang et al., U.S. Appl. No. 13/846,459, filed Mar. 18, 2013.
Zhou et al., U.S. Appl. No. 13/846,481, filed Mar. 18, 2013.
Darnell et al., U.S. Appl. No. 13/368,855, filed Feb. 8, 2012.
Darnell et al., U.S. Appl. No. 13/435,351, filed Mar. 30, 2012.

* cited by examiner

ANTENNA WITH TUNABLE HIGH BAND PARASITIC ELEMENT

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive structures can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antennas. An antenna may be formed from an antenna resonating element arm and an antenna ground. The antenna resonating element arm may have a shorter portion that resonates at higher communications band frequencies and a longer portion that resonates at lower communications band frequencies. The resonating element arm may be formed from a peripheral conductive electronic device housing structure that is separated from the antenna ground by an opening.

A parasitic monopole antenna resonating element or parasitic loop antenna resonating element may be located in the opening. Antenna tuning in the higher communications band may be implemented using an adjustable inductor in the parasitic element. Antenna tuning in the lower communications band may be implemented using an adjustable inductor that couples the antenna resonating element to the antenna ground.

Further features of the invention, its nature and various advantages will be more apparent from the accompanying drawings and the following detailed description of the preferred embodiments.

DETAILED DESCRIPTION

Figure 1:
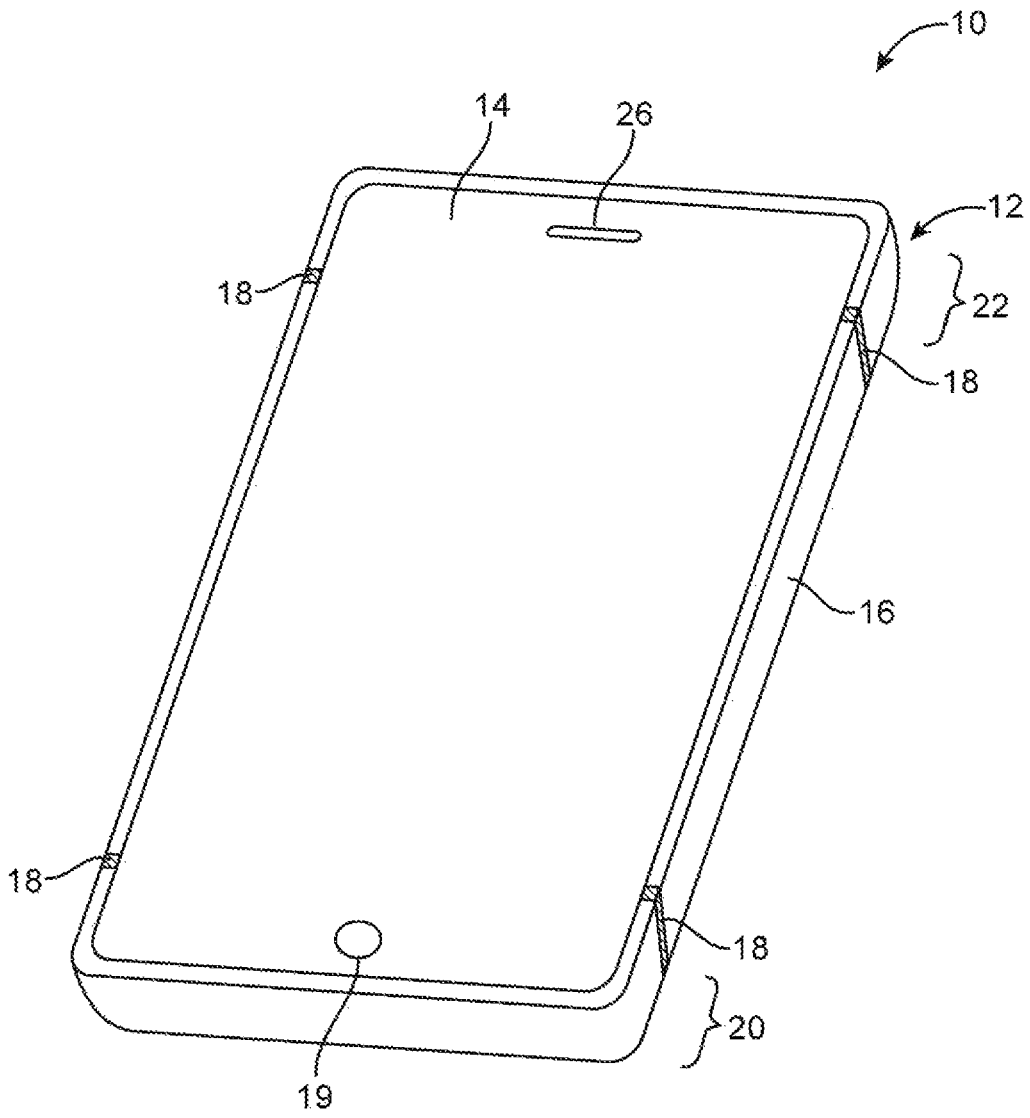
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer formed from clear glass, transparent plastic, or other transparent dielectric may cover the surface of display 14. Buttons such as button 19 may pass through openings in the display cover layer. The cover layer may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a metal band with vertical sidewalls surrounding the periphery of device 10, etc.).

Member 16 may be formed of a conductive material and may therefore sometimes be referred to as a peripheral conductive member, peripheral conductive housing member, or conductive housing structures. Member 16 may be formed from a metal such as stainless steel, aluminum, or other suitable materials. One, two, or more than two separate structures (e.g., segments) may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of housing 12 of the sidewalls of housing 12). Integral portions of the metal structure that forms member 16 may, if desired, extend across the rear of device 10 (e.g., housing 12 may have a planar rear portion and portions of peripheral conductive member 16 may be formed from sidewall portions of that extend vertically upwards from the planar rear portion).

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular member that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive member 16 and opposing conductive structures such as conductive housing structures, a conductive ground plane associated with a printed circuit board, and conductive electrical components in device 10). These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of member 16 may be provided with gap structures. For example, member 16 may be provided with one or more gaps such as gaps 18, as shown in FIG. 1. The gaps may be filled with dielectric such as polymer, ceramic, glass, air, other dielectric materials, or combinations of these materials. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
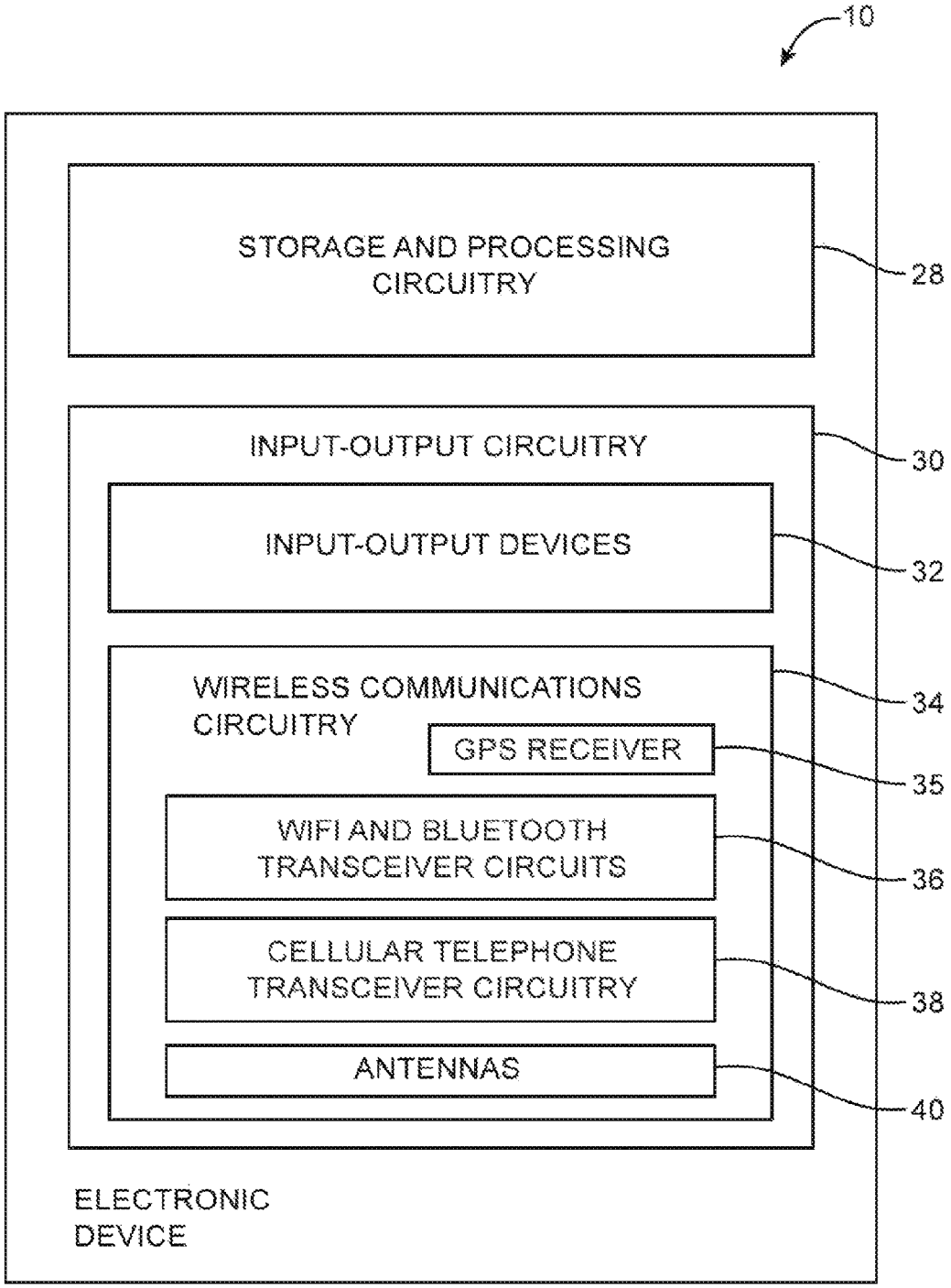
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle wireless local area network communications. For example, transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

If desired, one or more of antennas 40 may be provided with tunable circuitry. The tunable circuitry may include switching circuitry based on one or more switches. The switching circuitry may, for example, include a switch that can be placed in an open or closed position. When control circuitry 28 of device 10 places the switch in its open position, an antenna may exhibit a first frequency response. When control circuitry 28 of device 10 places the switch in its closed position, the antenna may exhibit a second frequency response. Tunable circuitry for one or more of antennas 40 may also be based on switching circuitry that can switch selected circuit components into use. For example, an adjustable inductor may operate in a first mode in which a first inductor is switched into use and a second mode in which a second inductor is switched into use. An adjustable inductor may optionally also be switched into a mode in which a short circuit is switched into use or in which an open circuit is formed.

Using adjustable inductors such as these or other adjustable circuit components, the performance of antenna 40 may be adjusted in real time to cover operating frequencies of interest.

Antenna 40 may exhibit both a low band response and a high band response. As an example, antenna 40 may operate at low band communications frequencies from 700 MHz to 960 MHz and may operate at high band communications frequencies above 1710 MHz (e.g., from 1710-2700 MHz). Adjustment of the state of adjustable inductors or other adjustable circuit components may be used to tune the low band response of the antenna without appreciably affecting the high band response and may be used to tune the high band response of the antenna without appreciably affecting the low band response. The ability to adjust the low and/or high band responses of the antenna may allow the antenna to cover communications frequencies of interest.

Figure 3:
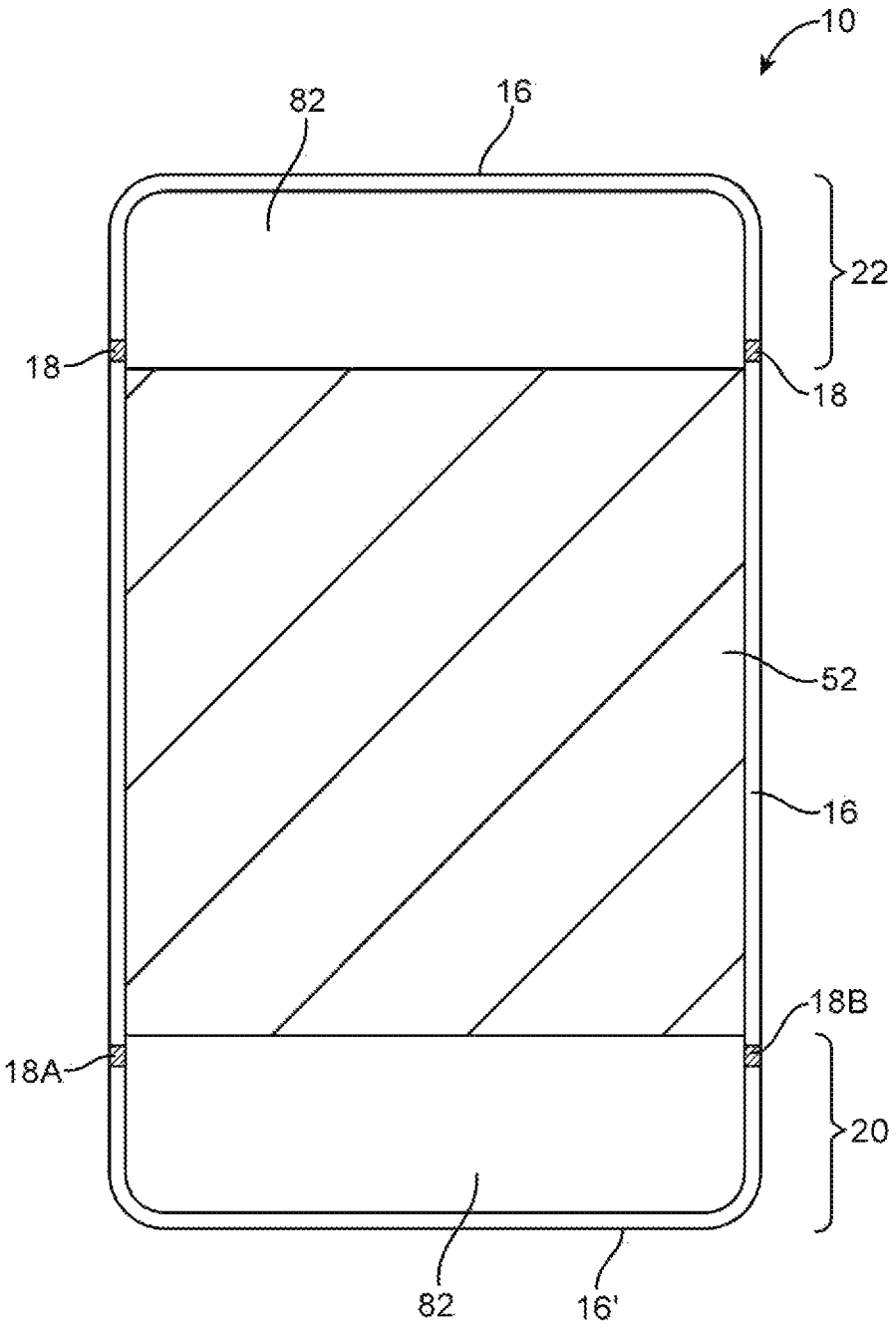
FIG. 3 is a top view of an illustrative electronic device of the type shown in FIG. 1 in which antennas may be formed using conductive housing structures such as portions of a peripheral conductive housing member in accordance with an embodiment of the present invention.

A top interior view of device 10 in a configuration in which device 10 has a peripheral conductive housing member such as housing member 16 of FIG. 1 with one or more gaps 18 is shown in FIG. 3. As shown in FIG. 3, device 10 may have an antenna ground plane such as antenna ground plane 52. Ground plane 52 may be formed from traces on printed circuit boards (e.g., rigid printed circuit boards and flexible printed circuit boards), from conductive planar support structures in the interior of device 10, from conductive structures that form exterior parts of housing 12, from conductive structures that are part of one or more electrical components in device 10 (e.g., parts of connectors, switches, cameras, speakers, microphones, displays, buttons, etc.), or other conductive device structures. Gaps such as gaps (openings) 82 may be filled with air, plastic, or other dielectric.

One or more segments of peripheral conductive member 16 may serve as antenna resonating elements for an antenna in device 10. For example, the uppermost segment of peripheral conductive member 16 in region 22 may serve as an antenna resonating element for an upper antenna in device 10 and the lowermost segment of peripheral conductive member 16 in region 20 (i.e., segment 16', which extends between gap 18A and gap 18B) may serve as an antenna resonating element for a lower antenna in device 10. The conductive materials of peripheral conductive member 16, the conductive materials of ground plane 52, and dielectric openings 82 (and gaps 18) may be used in forming one or more antennas in device 10 such as an upper antenna in region 22 and a lower antenna in region 20. Configurations in which an antenna in lower region 20 is implemented using a tunable frequency response configuration are sometimes described herein as an example.

Figure 4:
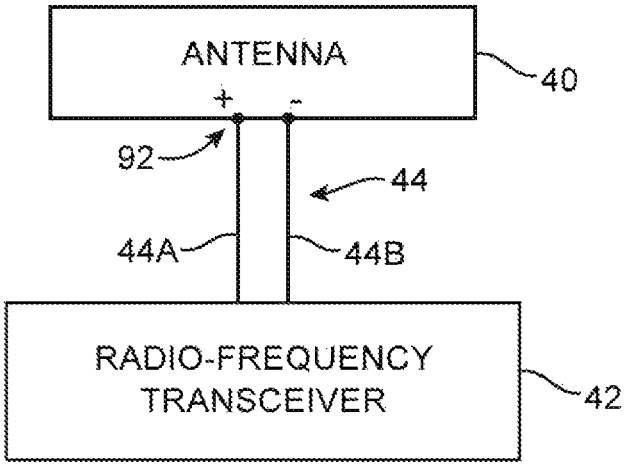
FIG. 4 is a circuit diagram showing how an antenna in the electronic device of FIG. 1 may be coupled to radio-frequency transceiver circuitry in accordance with an embodiment of the present invention.

FIG. 4 is a diagram showing how a radio-frequency signal path such as path 44 may be used to convey radio-frequency signals between antenna 40 and radio-frequency transceiver 42. Antenna 40 may be one of antennas 40 of FIG. 2. Radio-frequency transceiver 42 may be a receiver and/or transmitter in wireless communications circuitry 34 (FIG. 3) such as receiver 35, wireless local area network transceiver 36 (e.g., a transceiver operating at 2.4 GHz, 5 GHz, 60 GHz, or other suitable frequency), cellular telephone transceiver 38, or other radio-frequency transceiver circuitry for receiving and/or transmitting radio-frequency signals.

Signal path 44 may include one or more transmission lines such as one or more segments of coaxial cable, one or more segments of microstrip transmission line, one or more segments of stripline transmission line, or other transmission line structures. Signal path 44 may include a positive conductor such as positive signal line 44A and may include a ground conductor such as ground signal line 44B. Antenna 40 may have an antenna feed such as feed 92 with a positive antenna feed terminal (+) and a ground antenna feed terminal (−). If desired, circuitry such as filters, impedance matching circuits, switches, amplifiers, and other circuits may be interposed within path 44.

Figure 5:
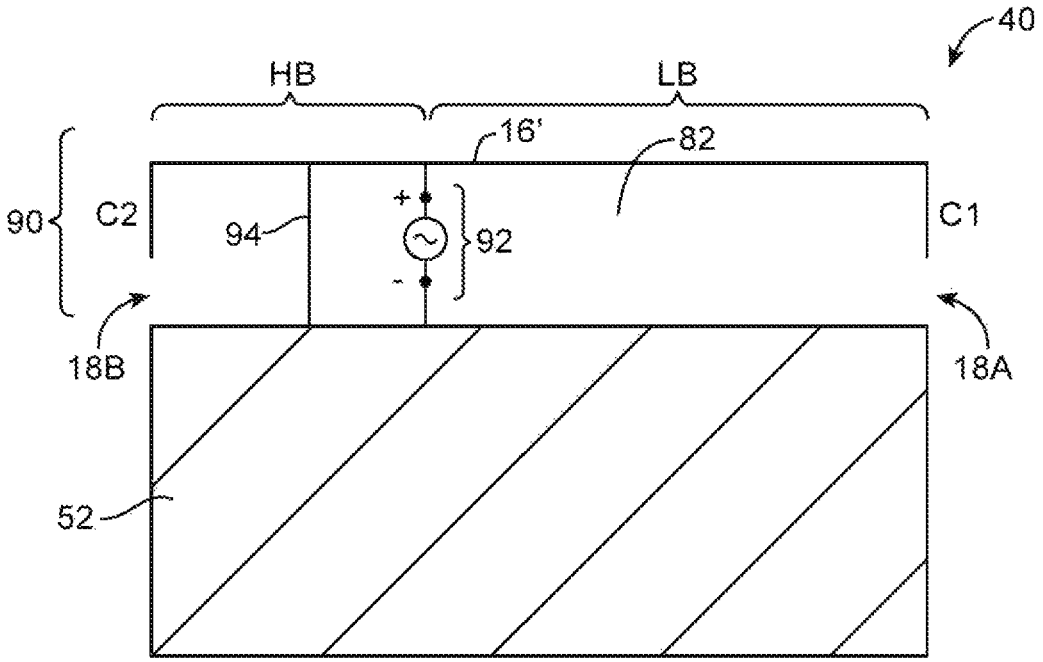
FIG. 5 is a diagram of an illustrative antenna having an antenna resonating element of the type that may be formed from a segment of a peripheral conductive housing member and that has portions that support communications in low and high bands in accordance with an embodiment of the present invention.

FIG. 5 is a diagram showing how structures such as peripheral conductive member segment 16' of FIG. 3 may be used in forming antenna 40. In the illustrative configuration of FIG. 5, antenna 40 includes antenna resonating element 90 and antenna ground 52. Antenna resonating element 90 may have a main resonating element arm portion formed from peripheral conductive member 16' (e.g., a segment of peripheral conductive member 16 of FIG. 1). Gaps such as gaps 18A and 18B may be interposed between the ends of resonating element arm structure 16' and ground 52 and may be associated with respective capacitances C1 and C2. Short circuit branch 94 (sometimes referred to as a return path for antenna 40) may be coupled between arm structure 16' and ground 52. Antenna feed branch (antenna feed) 92 may be coupled between arm structure 16' and ground 52 in parallel with short circuit branch 94. Antenna feed branch 92 may include a positive antenna feed terminal (+) and a ground antenna feed terminal (−). As described in connection with FIG. 4, lines 44A and 44B in signal path 44 may be respectively coupled to terminals (+) and (−) in antenna feed 92.

Resonating element arm structure 16' may have a longer portion (arm) that is associated with a low band resonance LB and that can be used for handling low band wireless communications. Resonating element arm 16' may also have a shorter portion (arm) that is associated with a high band resonance HB and that can be used for handling high band wireless communications. The low band portion of resonating element arm structure 16' may, for example, be used in handling signals at frequencies of 700 MHz to 960 MHz (as an example). The high band portion of arm structure 16' may, for example, be used in handling signals at frequencies of 1710 MHz to 2700 MHz (as an example).

Figure 6:
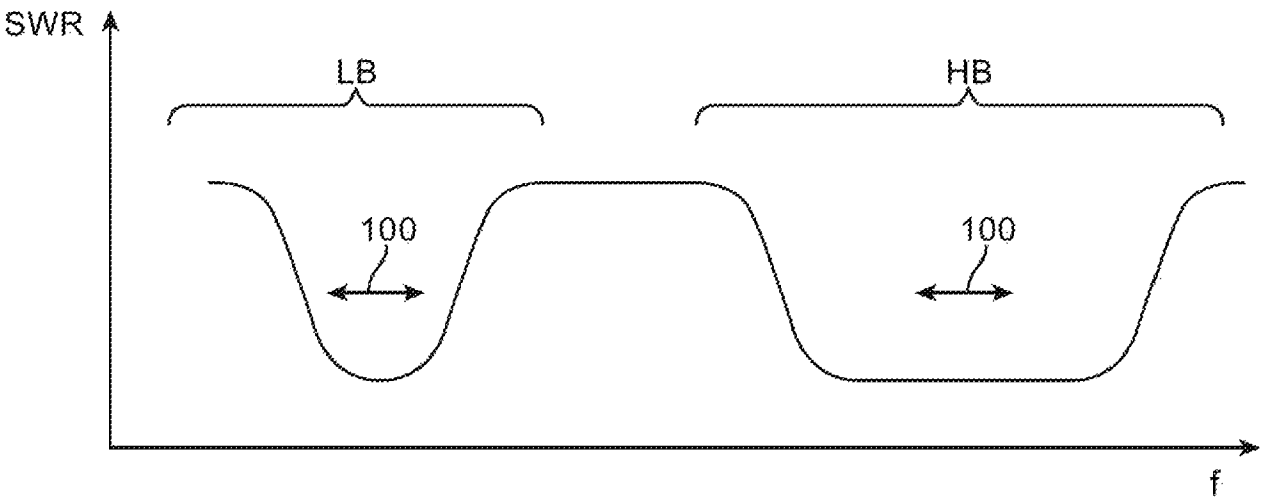
FIG. 6 is a graph in which antenna performance for a dual band inverted-F antenna has been plotted as a function of operating frequency in accordance with an embodiment of the present invention.

A graph in which antenna performance (e.g., standing wave ratio SWR) for antenna 40 has been plotted as a function of operating frequency f is shown in FIG. 6. As shown in FIG. 6, antenna 40 may exhibit a low band resonance LB and a high band resonance HB. As indicated by arrows 100, antenna tuning may be used to ensure that antenna 40 covers low band LB and/or high band HB. Low band LB may lie in a frequency range of about 700 MHz to 960 MHz and high band HB may lie in a frequency range of about 1710 MHz to 2700 MHz. These are merely illustrative low band and high band frequencies of operation for antenna 40. In general, antenna 40 may be configured to handle any suitable frequencies of interest for device 10. If desired, one or more adjustable inductors or other tunable circuit elements may be incorporated into antenna 40 to help antenna 40 cover bands LB and HB (e.g., to tune antenna 40 as indicated by arrows 100).

When tuning is used, antenna 40 may exhibit an antenna resonance that is narrower than the desired frequency band of interest. For example, the resonance in band LB may be narrower than the width of band LB. Tuning of the LB resonance may then be used to ensure that antenna 40 can handle all desired frequencies in band LB. Similarly, the bandwidth of the antenna resonance in band HB may be narrower than band HB, but antenna tuning may be used to move the antenna resonance in band HB as needed during operation to ensure that antenna 40 can cover all frequencies of interest in band HB.

Adjustable components may be controlled by control circuitry such as storage and processing circuitry 28 of FIG. 2. During operation of device 10, control circuitry 28 may make antenna adjustments by providing control signals to adjustable components such as adjustable inductors, adjustable capacitors, adjustable resistors, switches, switches in adjustable inductors, adjustable capacitors, and adjustable resistors, adjustable components such as variable inductors, varactors, and variable resistors, adjustable circuits that include combinations of two or more of these components and/or fixed inductors, capacitors, and resistors, or by providing control signals to other adjustable circuitry. Antenna frequency response adjustments may be made in real time in response to information identifying which communications bands are active, in response to feedback related to signal quality or other performance metrics, sensor information, or other information.

Figure 7:
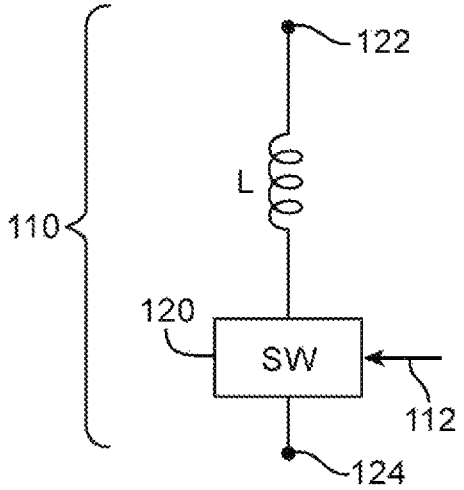
FIG. 7 is a diagram of an illustrative adjustable inductor based on a single fixed inductor that may be used in a tunable antenna in accordance with an embodiment of the present invention.

Antenna 40 may, if desired, include one or more adjustable inductor circuits that are controlled by control circuitry 28. FIG. 7 is a schematic diagram of illustrative adjustable inductor circuitry 110 of the type that may be used in tuning antenna 40. In the FIG. 7 example, adjustable inductor circuitry 110 can be adjusted to produce different amounts of inductance between terminals 122 and 124. Switch 120 is controlled by control signals on control input 112. When switch 120 is placed in a closed state, inductor L is switched into use and adjustable inductor 110 exhibits an inductance L between terminals 122 and 124. When switch 120 is placed in an open state, inductor L is switched out of use and adjustable inductor 110 exhibits an open circuit between terminals 122 and 124.

Figure 8:
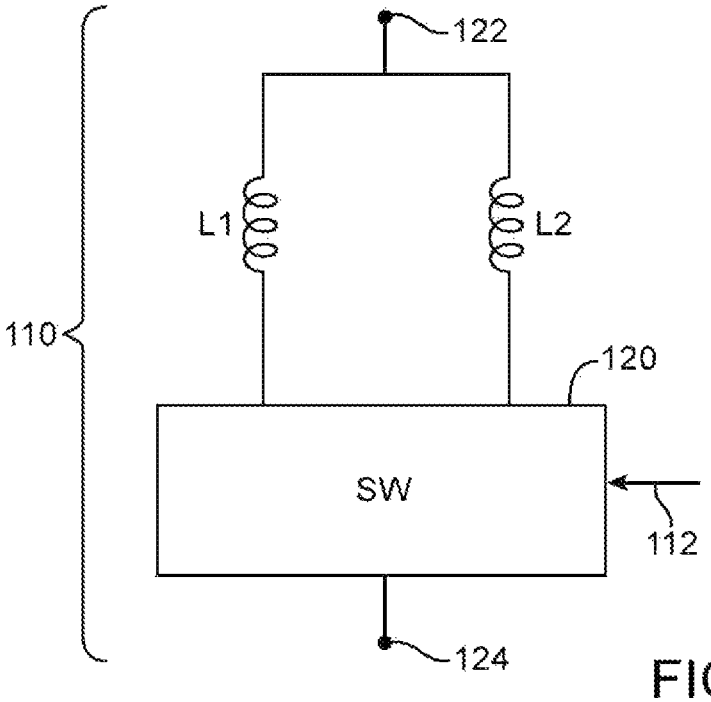
FIG. 8 is a diagram of an illustrative adjustable inductor based on multiple fixed inductors that may be used in a tunable antenna in accordance with an embodiment of the present invention.

FIG. 8 is a schematic diagram of adjustable inductor circuitry 110 in a configuration in which multiple inductors are used in providing an adjustable amount of inductance. Adjustable inductor circuitry 110 of FIG. 8 can be adjusted to produce different amounts of inductance between terminals 122 and 124 by controlling the state of switching circuitry such as switch 120 (e.g., a single pole double throw switch) using control signals on control input 112. For example, control signals on path 112 may be used to switch inductor L1 into use between terminals 122 and 124 while switching inductor L2 out of use, may be used to switch inductor L2 into use between terminals 122 and 124 while switching inductor L1 out of use, may be used to switch both inductors L1 and L2 into use in parallel between terminals 122 and 124, or may be used to switch both inductors L1 and L2 out of use. The switching circuitry arrangement of adjustable inductor 110 of FIG. 8 is therefore able to produce inductance values such as L1, L2, an inductance value associated with operating L1 and L2 in parallel, and an open circuit (when L1 and L2 are switched out of use simultaneously).

Antenna 40 may include a parasitic antenna resonating element. The parasitic antenna element may, for example, be used to enhance the frequency response of antenna 40 in high band HB (as an example). Tuning circuitry may be used to tune the resonant behavior of the parasitic antenna resonating element and thereby tune the performance of antenna 40 in high band HB.

Figure 9:
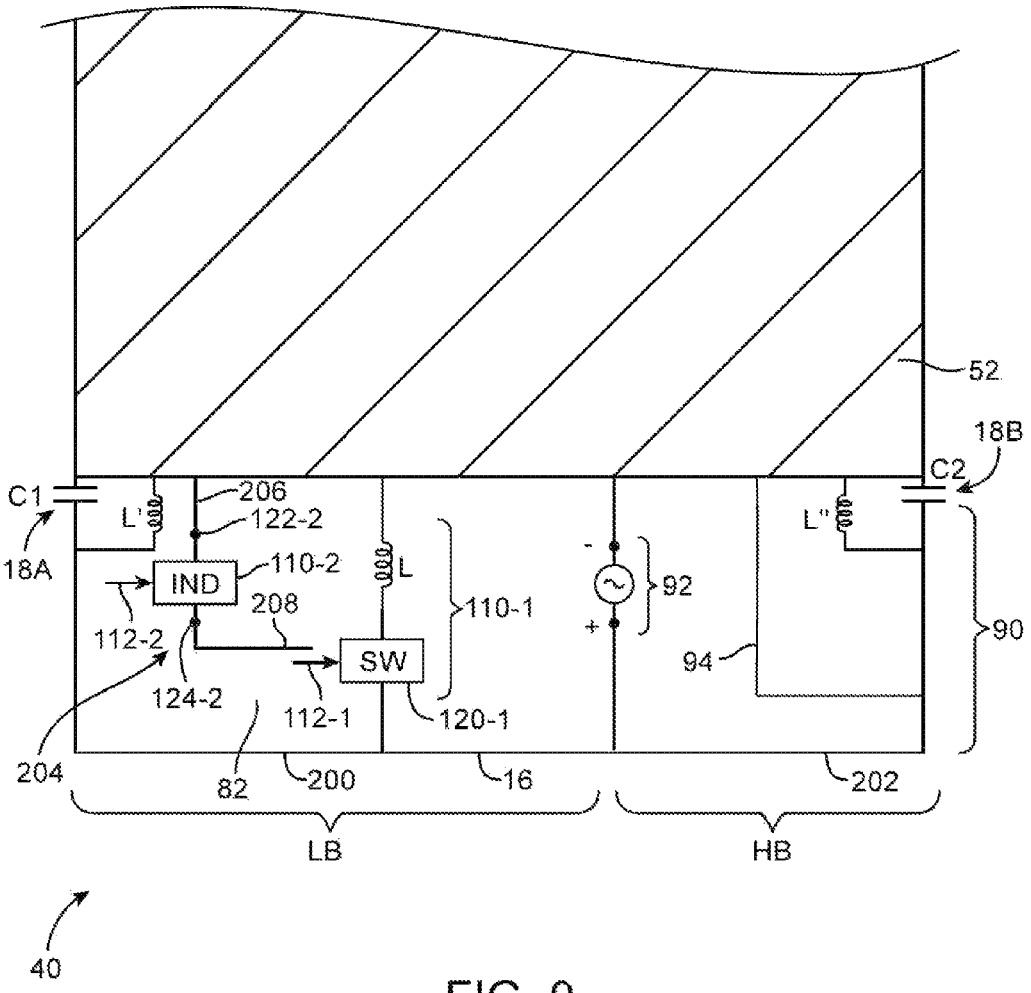
FIG. 9 is a diagram of an illustrative antenna having a parasitic monopole antenna resonating element and adjustable components for providing the antenna with tunable low and high band responses in accordance with an embodiment of the present invention.

FIG. 9 is a diagram of an illustrative antenna of the type that may be implemented using a parasitic antenna resonating element. As shown in FIG. 9, dual arm inverted-F antenna resonating element 90 may be formed from portions of peripheral conductive housing structures 16. In particular, resonating element arm portion (arm) 202 for producing an antenna response in a high band (HB) frequency range and resonating element arm portion (arm) 200 for producing an antenna response in a low band (LB) frequency range may be formed from respective portions of peripheral conductive housing structures 16. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

Antenna 40 may be fed by an antenna feed coupled in feed path 92. Feed path 92 may include an antenna feed formed from antenna feed terminals such as positive antenna feed terminal (+) and ground antenna feed terminal (−). Transmission line 44 (FIG. 4) may have a positive signal line coupled to terminal (+) and a ground signal line coupled to terminal (−). Impedance matching circuits and other circuitry (e.g., filters, switches, etc.) may be incorporated into feed path 92 or transmission line 44, if desired.

Optional inductors such as inductors L' and L" (e.g., fixed inductors or tunable inductors) may be coupled across gaps 18A and 18B to counteract the capacitances (C1 and C2) associated with gaps 18A and 18B and thereby ensure that antenna 40 operates at frequencies of interest (i.e., so that antenna 40 exhibits a low band response above 690 MHz). Short circuit path 94 may be used to short resonating element arm 202 to ground 52 or may be omitted (e.g., in a configuration in which inductor L" is used to form a return path for antenna 40).

Adjustable inductor 110-1 may have switching circuitry such as switch 120-1 that receives control signals from control circuitry 28 on input 112-1. When inductor L is switched into use, antenna 40 may be configured so that the low band resonance of antenna 40 covers an upper portion of low band LB (e.g., frequencies up to 960 MHz). When inductor L is switched out of use, antenna 40 may be configured so that the low band resonance of antenna 40 covers a lower portion of low band LB (e.g., frequencies down to about 700 MHz). If desired, other types of tunable circuitry may be used in adjusting the low band performance of antenna 40. The use of an inductor such as adjustable inductor 110-1 that is coupled between resonating element 90 and ground 52 to tune the performance of antenna 40 in low band LB is merely illustrative.

Parasitic antenna resonating element 204 may have an L-shape or other suitable shape. Parasitic antenna resonating element 204 may be, for example, a parasitic monopole antenna resonating element having a first end such as end 206 that is coupled to ground 52 and a second end such as end 208 that is floating in opening 82. The length of monopole antenna resonating element 204 may be approximately a quarter of a wavelength at frequencies of interest (i.e., frequencies in band HB where it is desired to use the antenna resonance associated with parasitic antenna resonating element 204 to enhance antenna performance).

Parasitic antenna resonating element 204 may have tunable circuitry such as adjustable inductor 110-2. Inductor 110-2 may be adjusted by commands on input 112-2. Adjustable inductor 110-2 may have multiple inductors and switching circuitry that can be configured to selectively switch the inductors in and out of use to produce a desired amount of inductance between terminals 122-2 and 124-2. Adjustable inductor 110-2 may, for example, have switching circuitry such as switching circuitry 120 of FIG. 8 and a pair of inductors such as inductors L1 and L2 of FIG. 8 (as an example).

Adjustments to inductor 110-2 may be used to adjust the performance of antenna 40. For example, adjusting the inductance value produced by adjustable inductor 110-2 in parasitic antenna resonating element 204 may adjust the position of a high band antenna resonance located in high band HB of FIG. 6, as indicated by arrow 100 in high band HB. Inductors such as inductor 110-2 and/or inductor 110-1 may be implemented using fixed inductors or other types of adjustable circuitry can be used to tune antenna 40. The use of adjustable inductors to tune antenna 40 of FIG. 9 is merely illustrative.

Figure 10:
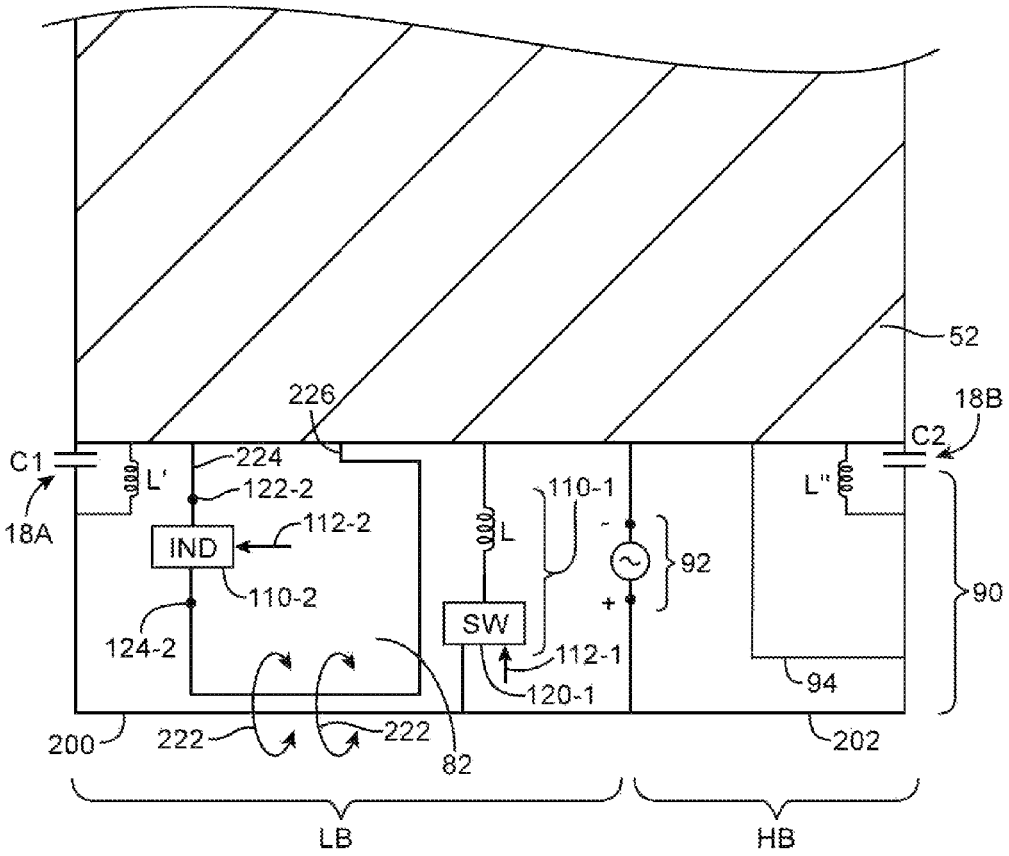
FIG. 10 is a diagram of an illustrative antenna having a parasitic loop antenna resonating element and adjustable components for providing the antenna with tunable low and high band responses in accordance with an embodiment of the present invention.

If desired, antenna 40 may contain a parasitic loop antenna resonating element, as indicated by illustrative antenna 40 of FIG. 10. A shown in FIG. 10, antenna 40 may have parasitic loop antenna resonating element 220. Parasitic loop antenna resonating element 220 may have a first end such as end 224 that is coupled to ground 52 at a first location and may have a second end such as end 226 that is coupled to ground 52 at a second end such as end 226. Parasitic loop antenna resonating element 220 may be electromagnetically coupled (near field coupled) to antenna resonating element 90, as indicated by coupled electromagnetic fields 222 in FIG. 10.

Antenna 40 of FIG. 10 may have a resonating element such as dual arm inverted-F antenna resonating element 90 that is formed from portions of peripheral conductive housing structures 16. Resonating element arm portion 202 may produce an antenna response in high band HB and resonating element arm portion 200 may produce an antenna response in a low band LB. Antenna 40 may also have antenna ground 52. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

Antenna 40 may be fed by an antenna feed coupled in feed path 92. Feed path 92 may include an antenna feed formed from antenna feed terminals such as positive antenna feed terminal (+) and ground antenna feed terminal (−). Transmission line 44 (FIG. 4) may have a positive signal line coupled to terminal (+) and a ground signal line coupled to terminal (−). Impedance matching circuits and other circuitry (e.g., filters, switches, etc.) may be incorporated into feed path 92 or transmission line 44, if desired.

As with inductors L' and L" in antenna 40 of FIG. 9, optional inductors in antenna 40 of FIG. 10 such as inductors L' and L" may be coupled across gaps 18A and 18B to counteract the capacitances (C1 and C2) associated with gaps 18A and 18B and thereby ensure that antenna 40 operates at frequencies of interest (i.e., so that antenna 40 exhibits a low band response above 690 MHz). Short circuit path 94 may be used to short resonating element arm 202 to ground 52 or may be omitted (e.g., in a configuration in which inductor L" is used to form a return path for antenna 40).

Low band tuning for antenna 40 of FIG. 10 may be implemented using tunable circuitry such as adjustable inductor 110-1. Adjustable inductor 110-1 may have switching circuitry such as switch 120-1 that receives control signals from control circuitry 28 on input 112-1. When inductor L is switched into use, antenna 40 may be configured so that the low band resonance of antenna 40 covers an upper portion of low band LB (e.g., frequencies up to 960 MHz). When inductor L is switched out of use, antenna 40 may be configured so that the low band resonance of antenna 40 moves to lower frequencies and covers a lower portion of low band LB (e.g., frequencies down to about 700 MHz). If desired, other types of tunable circuitry may be used in adjusting low band performance. The use of adjustable inductor 110-1 to tune the performance of antenna 40 of FIG. 10 in low band LB is merely illustrative.

The length of parasitic loop antenna resonating element 220 may be configured to exhibit an antenna resonance at frequencies of interest (i.e., frequencies in band HB where it is desired to use the antenna resonance associated with parasitic loop antenna resonating element 220 to enhance antenna performance).

Parasitic loop antenna resonating element 220 may have tunable circuitry such as adjustable inductor 110-2. Control signals from control circuitry 28 may be applied to input 112-2 to adjust inductor 110-2. Adjustable inductor 110-2 may have multiple inductors and switching circuitry that can be configured to selectively switch the inductors in and out of use to produce a desired amount of inductance between terminals 122-2 and 124-2. Adjustable inductor 110-2 may, for example, have switching circuitry such as switching circuitry 120 of FIG. 8 and a pair of inductors such as inductors L1 and L2 of FIG. 8 (as an example). Adjustments to inductor 110-2 may be used to adjust the performance of antenna 40 of FIG. 10. For example, adjusting the inductance value produced by adjustable inductor 110-2 in parasitic loop antenna resonating element 220 may tune the position of a high band antenna resonance located in high band HB of FIG. 6, as indicated by arrow 100 in high band HB. Inductors such as inductor 122-2 and/or inductor 110-1 may be implemented using fixed inductors or other types of adjustable circuitry can be used to tune antenna 40. The use of adjustable inductors to tune antenna 40 of FIG. 10 is merely illustrative.

The foregoing is merely illustrative of the principles of this invention and various modifications can be made by those skilled in the art without departing from the scope and spirit of the invention.

What is claimed is:

1. An electronic device, comprising:

control circuitry;

an antenna that is tuned by the control circuitry, wherein the antenna has an antenna resonating element and an antenna ground configured to resonate in at least a first communications band and a second communications band that is higher in frequency than the first communications band, and the antenna has a parasitic monopole antenna resonating element; and a peripheral conductive housing member, wherein the antenna resonating element comprises a portion of the peripheral conductive housing member.

2. The electronic device defined in claim 1 further comprising an adjustable electrical component in the parasitic monopole antenna resonating element that is adjusted by the control circuitry.

3. The electronic device defined in claim 2 wherein the adjustable electrical component comprises an adjustable inductor.

4. The electronic device defined in claim 1 wherein the peripheral conductive housing member is separated from the antenna ground by an opening and wherein the parasitic monopole antenna resonating element is located in the opening.

5. The electronic device defined in claim 4 wherein the parasitic monopole antenna resonating element comprises an L-shaped resonating element having a first end coupled to the antenna ground and an opposing second end that is floating in the opening.

6. An electronic device, comprising:

control circuitry;

an antenna that is tuned by the control circuitry, wherein the antenna has an antenna resonating element and an antenna ground configured to resonate in at least a first communications band and a second communications band that is higher in frequency than the first communications band, and the antenna has a parasitic monopole antenna resonating element;

an adjustable electrical component in the parasitic monopole antenna resonating element that is adjusted by the control circuitry, wherein the adjustable electrical component comprises an adjustable inductor; and an additional adjustable inductor coupled between the antenna resonating element and the antenna ground, wherein the adjustable inductor tunes the antenna in the second communications band and the additional adjustable inductor tunes the antenna in the first communications band.

7. The electronic device defined in claim 6 further comprising:

a first gap between the antenna resonating element and the antenna ground that is associated with a first capacitance;

a first inductor coupled across the first gap;

a second gap between the antenna resonating element and the antenna ground that is associated with a second capacitance; and a second inductor that is coupled across the second gap.

8. The electronic device defined in claim 7 wherein the antenna resonating element comprises a dual arm inverted-F antenna resonating element, the electronic device further comprising an antenna feed coupled between the antenna ground and the dual arm inverted-F antenna resonating element.

9. An electronic device, comprising:

control circuitry; and an antenna that is tuned by the control circuitry, wherein the antenna has an antenna resonating element and an antenna ground configured to resonate in at least a first communications band and a second communications band that is higher in frequency than the first communications band, the antenna has a parasitic loop antenna resonating element, and the parasitic loop antenna resonating element has a first end that is coupled to the antenna ground and a second end that is coupled to the antenna ground.

10. The electronic device defined in claim 9 further comprising an adjustable inductor in the parasitic loop antenna resonating element that is adjusted by the control circuitry to tune the antenna.

11. The electronic device defined in claim 10 further comprising a peripheral conductive housing member, wherein the antenna resonating element comprises a portion of the peripheral conductive housing member.

12. An electronic device, comprising:

control circuitry;

an antenna that is tuned by the control circuitry, wherein the antenna has an antenna resonating element and an antenna ground configured to resonate in at least a first communications band and a second communications band that is higher in frequency than the first communications band, and the antenna has a parasitic loop antenna resonating element; and a peripheral conductive housing member that is separated from the antenna ground by an opening, wherein the antenna resonating element is formed from a segment of the peripheral conductive housing member, and the loop antenna resonating element is located in the opening.

13. The electronic device defined in claim 12 further comprising:

a first adjustable inductor in the parasitic loop antenna resonating element that is adjusted by the control circuitry to tune the antenna in the second communications band; and a second adjustable inductor that couples the peripheral conductive housing member to the antenna ground and that is adjusted by the control circuitry to tune the antenna in the first communications band.

14. The electronic device defined in claim 13 wherein the peripheral conductive housing member has at least one end that is separated from the antenna ground by a gap, the electronic device further comprising an inductor that is coupled across the gap.

15. An antenna, comprising:

an inverted-F antenna resonating element;

an antenna ground;

a parasitic antenna resonating element; and an adjustable inductor in the parasitic antenna resonating element that tunes the antenna, wherein the inverted-F antenna resonating element comprises a portion of a peripheral conductive electronic device housing structure.

16. The antenna defined in claim 15 wherein the antenna is configured to operate in a first communications band and a second communications band at higher frequencies than the first communications band, wherein the parasitic antenna resonating element comprises a parasitic monopole antenna resonating element, and wherein the adjustable inductor tunes the antenna in the second communications band.

17. The antenna defined in claim 15 wherein the antenna is configured to operate in a first communications band and a second communications band at higher frequencies than the first communications band, wherein the parasitic antenna resonating element comprises a parasitic loop antenna resonating element, and wherein the adjustable inductor tunes the antenna in the second communications band.

* * * * *